US008117880B2

(12) United States Patent
Onishi et al.

(10) Patent No.: US 8,117,880 B2
(45) Date of Patent: Feb. 21, 2012

(54) BILLET-REARRANGING DEVICE

(75) Inventors: Takeharu Onishi, Niihama (JP); Shinobu Masuda, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 524 days.

(21) Appl. No.: 12/300,290

(22) PCT Filed: Mar. 9, 2007

(86) PCT No.: PCT/JP2007/054652

§ 371 (c)(1),
(2), (4) Date: Feb. 9, 2009

(87) PCT Pub. No.: WO2007/132585

PCT Pub. Date: Nov. 22, 2007

(65) Prior Publication Data

US 2010/0064761 A1 Mar. 18, 2010

(30) Foreign Application Priority Data

May 12, 2006 (JP) ..... 2006-133252

(51) Int. Cl.
*B21C 33/00* (2006.01)
*B21J 13/10* (2006.01)
*B21D 43/20* (2006.01)

(52) U.S. Cl. ..... 72/270; 72/420; 72/424

(58) Field of Classification Search ..... 72/270, 72/4, 361, 419, 420, 421, 424, 426
See application file for complete search history.

(56) References Cited

U.S. PATENT DOCUMENTS 3,467,236 A * 9/1969 Dhanda ..... 198/389
4,387,796 A * 6/1983 Enomae ..... 198/374
4,544,002 A * 10/1985 Aronson ..... 72/424
4,551,913 A * 11/1985 Campisi ..... 198/409

FOREIGN PATENT DOCUMENTS

JP 52-036708 U 3/1977
JP 04-044220 U 4/1992
JP 06-115664 A 4/1994
JP 11-057921 A 3/1999

OTHER PUBLICATIONS

International Search Report for the Application No. PCT/JP2007/054652 mailed May 15, 2007.
"Plastic-Working Technology: Series 4 Forging", Corona, Tokyo, First Edition in Aug. 1995, p. 199.

* cited by examiner

*Primary Examiner* — Dana Ross
*Assistant Examiner* — Mohammad I Yusuf
(74) *Attorney, Agent, or Firm* — Cheng Law Group PLLC

(57) ABSTRACT

This invention provides a billet-rearranging device which receives billets fed in a row and rearranges two billets in tandem. The billet-rearranging device "A" is disposed between a chute "S" with an outlet to feed billets "b" in a row to the device "A" and a charger "Cg" with a holder unit "B" with two holders "B1" and "B2" to hold two billets "b" in tandem and has a billet-rearranging mechanism to rearrange two billets "b" in tandem and feed them to the holder unit "B" of the charger "Cg." The billet-rearranging mechanism comprising (i) an upper slide plate 1 positioned below the outlet of the chute "S", (ii) a lower slide plate 2 positioned below the upper slide plate 1, and (iii) a fixed plate 3 positioned below the lower slide plate 2, above the holder unit "B" of the charger "Cg." The upper slide plate 1 has the function of rearranging two billets "b" in tandem. The lower slide plate 2 has the function of feeding two billets "b" in tandem one by one to the fixed plate 3. The fixed plate 3 has the function of guiding two billets "b" in tandem simultaneously to the holder unit "B."

1 Claim, 4 Drawing Sheets

BILLET-REARRANGING DEVICE

TECHNICAL FIELD

This invention relates to a billet-rearranging device. More specifically, this invention relates to a billet-rearranging device which rearranges two of the billets fed in a row from a chute in tandem and feeds them to the charger of an automatic multi-step forging press.

BACKGROUND ART

Multi-step forging presses are coming into use to raise productivity. They consist of a plurality of steps (for example, four steps), each step provided with a forging die, to do the pressing of all the steps at a stroke. However, because each step has only one forging die and, therefore, only one billet is fed to each step at a time, there is a limit to the improvement of productivity (see page 199, *Plastic-Working Technology: Series* 4 *Forging*. Tokyo: Corona. First Edition in August 1995).

Under the circumstances, multi-step forging presses consisting of a plurality of steps, each step provided with more than one die, are being developed. However, billets are fed in a row through a chute; therefore, the same number of billets as the number of dies in each step have to be rearranged in tandem before they are fed to the first step of the press. However, such a billet-rearranging device is not yet available.

DISCLOSURE OF THE INVENTION

Problems that the Invention is to Solve

Accordingly, the object of the present invention is to provide a billet-rearranging device which rearranges two of the billets fed in a row from a chute in tandem.

Means of Solving the Problems

According to the first feature of the present invention, there is provided a billet-rearranging device disposed between a chute with an outlet to feed billets in a row to the device and a charger with a holder unit to hold two billets in tandem. The billet-rearranging device has a billet-rearranging mechanism to rearrange two billets in tandem and feed them to the holder unit of the charger.

According to the second feature of the present invention, there is provided the billet-rearranging device according to the first feature. The billet-rearranging mechanism of the billet-rearranging device comprises (i) an upper slide plate positioned below the outlet of the chute, (ii) a lower slide plate positioned below the upper slide plate, and (iii) a fixed plate positioned below the lower slide plate, above the holder unit of the charger. The upper slide plate has the function of rearranging two billets in tandem. The lower slide plate has the function of feeding two billets in tandem one by one to the fixed plate. The fixed plate has the function of guiding two billets in tandem simultaneously to the holder unit of the charger.

According to the third feature of the present invention, there is provided the billet-rearranging device according to the second feature. The holder unit of said charger is provided with a first and a second holder in tandem, the first holder positioned in front of the position (hereinafter "center position") right under the outlet of said chute and the second holder positioned in the rear of the center position. The fixed plate of the billet-rearranging mechanism of the billet-rearranging device has a first and a second guide hole which are positioned right above the first and second holders, respectively, of the holder unit of the charger. The lower slide plate of the billet-rearranging mechanism of the billet-rearranging device has a first and a second receiving hole, the first receiving hole coming to the center position when the lower slide plate is slid most forward and the first and second receiving holes positioned right above the first and second guide holes, respectively, of the fixed plate when the lower slide plate is slid most backward. The upper slide plate of the billet-rearranging mechanism of the billet-rearranging device has a rearranging hole, the rearranging hole positioned right above the first receiving hole of the lower slide plate when the upper and lower slide plates are slid most backward and forward, respectively, and the rearranging hole positioned right above the second receiving hole of the lower slid plate when the upper and lower slide plates are slid most forward and backward, respectively.

Effects of the Invention

The advantage offered by the first feature of the present invention is as follows. Because the billet-rearranging mechanism rearranges two billets in tandem, two billets in tandem are fed to the holder unit of the charger.

The advantage offered by the second feature of the present invention is as follows. The upper slide plate has the function of rearranging two billets in tandem. The lower slide plate has the function of feeding two billets in tandem one by one to the fixed plate. The fixed plate has the function of guiding two billets in tandem simultaneously to the holder unit of the charger. Thus, two billets in tandem are fed to the holder unit of the charger.

The advantage offered by the third feature of the present invention is as follows. Each of the billets fed in a row from the chute first enter the rearranging hole of the upper slide plate, and a billet is put in each of the first and second receiving holes of the lower slide plate by sliding the upper and lower slide plates. Then, the first and second receiving holes of the lower slide plate are positioned right above the first and second guide holes, respectively, of the fixed plate by sliding the lower slide plate to feed two billets into the two holders in tandem of the holder unit of the charger.

BEST MODE FOR CARRYING OUT THE INVENTION

Figure 4:
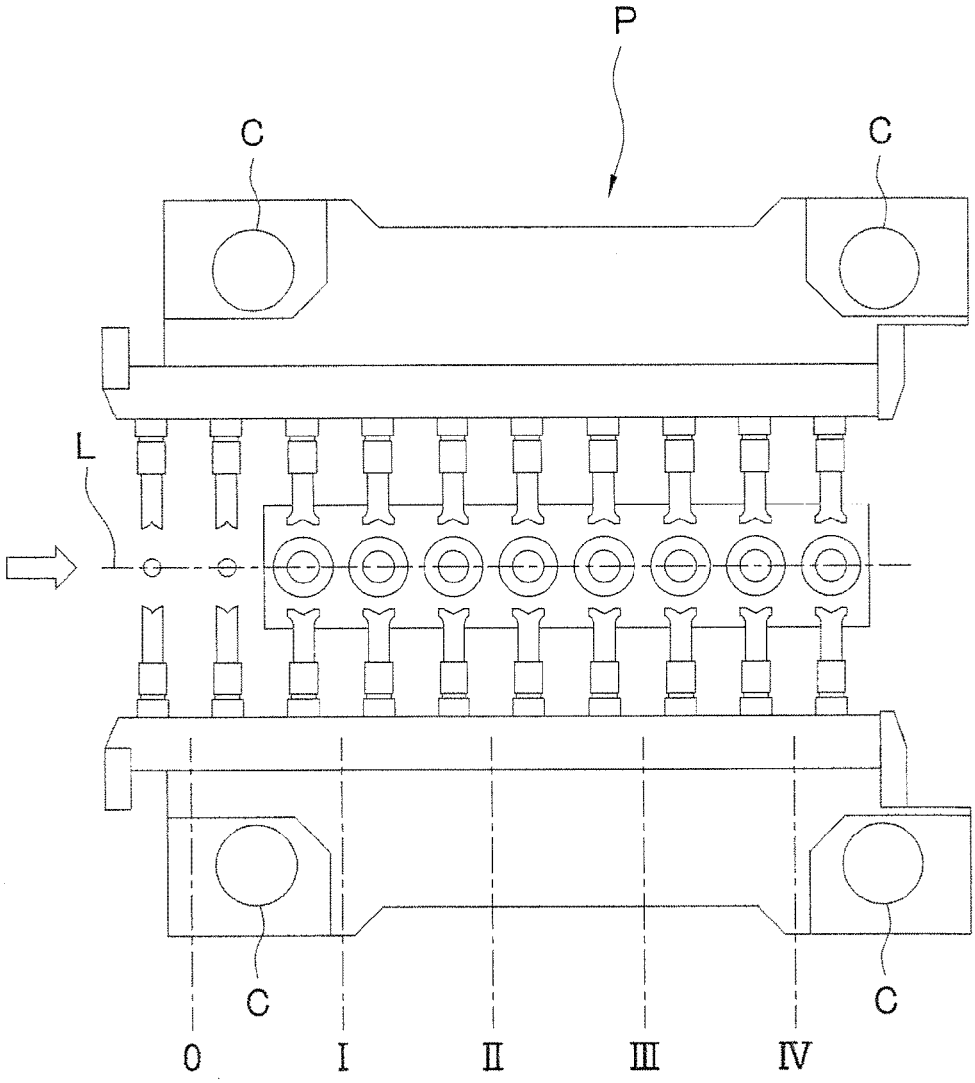
FIG. 4 is a schematic plan view of a multi-step forging press.

By referring to drawings, an embodiment of the billet-rearranging device according to the present invention will be described below. FIG. 4 is a schematic plan view of a forging press "P" which the billet-rearranging device feeds billets to. The forging process of the forging press "P" consists of four steps I, II, III, and IV as shown in FIG. 4. The reference numeral 0 is a pre-step. A pair of dies is provided in tandem in each of the steps I, II, III, and IV. The reference signs "C" are press columns. The four pairs of dies are arranged along the path line "L" of the forging press "P."

Because a pair of dies is provided in each of the steps I, II, III, and IV, the production efficiency is double what it would be if a single die were provided in each step.

Figure 3:
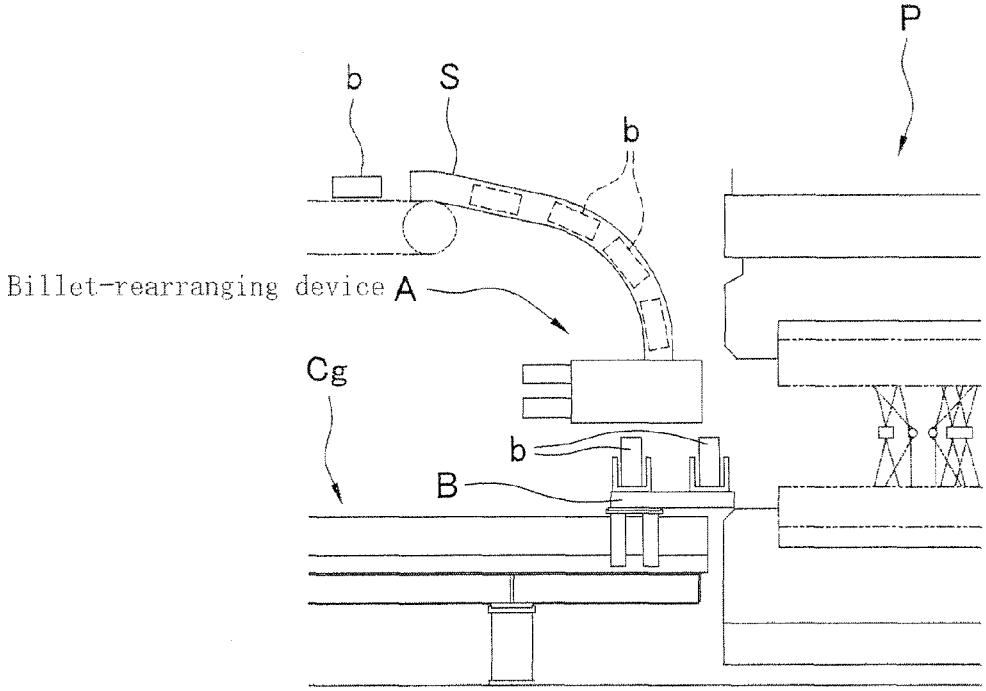
FIG. 3 is an illustration showing a chute, the billet-rearranging device of FIG. 1, a billet charger, and an automatic multi-step forging press.

In FIG. 3, the reference sign "A" is an embodiment of the billet-rearranging device according to the present invention and the reference signs "S" and "Cg" are a chute and a charger, respectively. The charger "Cg" has a holder unit "B," which is provided with a pair of holders "B1" and "B2" in tandem. Billets are heated in a heating furnace (not shown) and fed in a row to the billet-rearranging device "A" through the chute "S." The billet-rearranging device "A" sets two billets in the holders "B1" and "B2" and the charger "Cg" feeds the two billets to the pre-step 0 of the forging press "P."

Next, the billet-rearranging device "A" will be described below.

Figure 1:
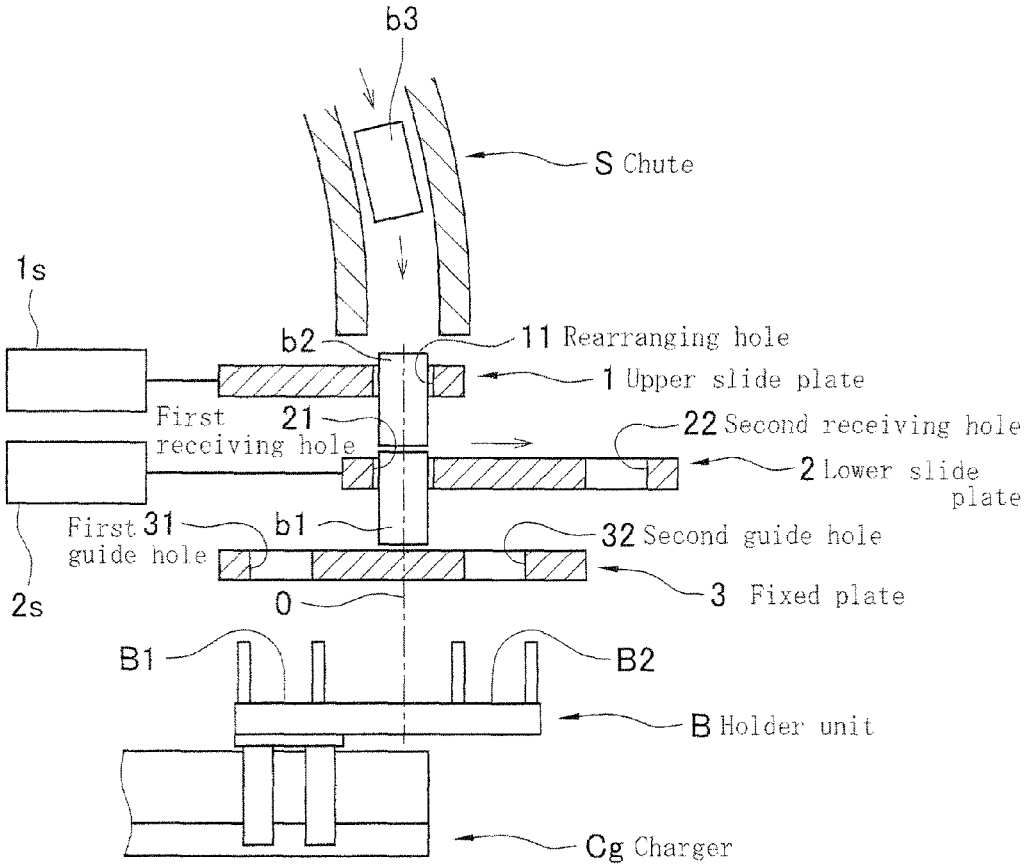
FIG. 1 is an illustration showing the construction of an embodiment of the billet-rearranging device according to the present invention.
Figure 2:
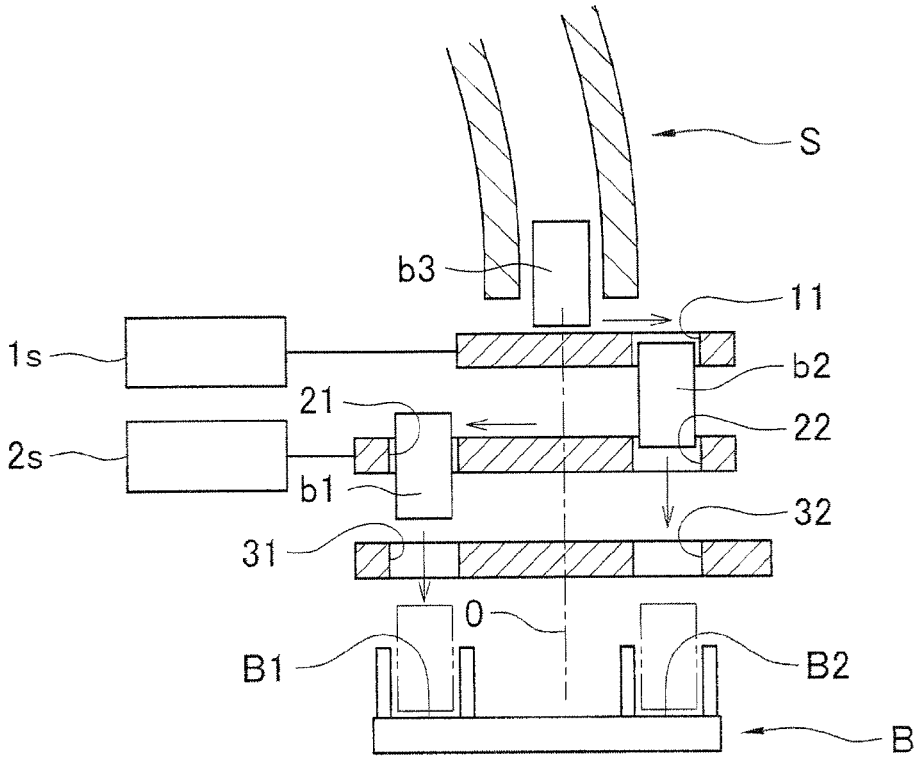
FIG. 2 is an illustration showing the working of the billet-rearranging device of FIG. 1.

FIG. 1 is an illustration showing the construction of the billet-rearranging device "A." FIG. 2 is an illustration showing the working of the billet-rearranging device "A."

As shown in FIG. 1, the billet-rearranging device "A" is disposed between the chute "S" and the charger "Cg." Billets are fed in a row through the chute "S" to the billet-rearranging device "A." The holder unit "B" of the charger "Cg" comprises two holders "B1" and "B2" in tandem. The billet-rearranging device "A" has a billet-rearranging mechanism to rearrange two of the billets fed in a row from the chute in tandem at a time before they are fed to the charger "Cg." As shown in FIG. 1, when the holder unit "B" is in its billet-receiving position, the holder "B1" is positioned in front of the position (hereinafter "center position 0") right under the outlet of the chute "S" and the holder "B2" is positioned in the rear of the center position 0.

As shown in FIG. 1, the billet-rearranging mechanism comprises an upper slide plate 1 positioned below the outlet of the chute "S," a lower slide plate 2 positioned below the upper slide plate 1, and a fixed plate 3 positioned below the lower slide plate 2, above the holder unit "B."

The upper slide plate 1 is slid by a cylinder 1*s* and has the function of rearranging two billets in tandem.

The lower slide plate 2 is slid by a cylinder 2*s* and has the function of feeding two billets in tandem one by one to the fixed plate 3.

The fixed plate 3 has the function of guiding two billets in tandem simultaneously into the holders "B1" and "B2."

Next, the construction of the plates 1, 2, and 3 will be described below.

The fixed plate 3 has a first guide hole 31 and a second guide hole 32 which are positioned right above the holders "B1" and "B2," respectively, when the holder unit "B" is in its billet-receiving position.

The lower slide plate 2 has a first receiving hole 21 and a second receiving hole 22. As shown in FIG. 1, when the lower slide plate 2 is slid most forward, the first receiving hole 21 comes to the center position 0. As shown in FIG. 2, when the lower slide plate 2 is slid most backward, the first and second receiving holes 21 and 22 are positioned right above the first and second guide holes 31 and 32, respectively.

The upper slide plate 1 has a rearranging hole 11. As shown in FIG. 1, when the upper and lower slide plates 1 and 2 are slid most backward and forward, respectively, the rearranging hole 11 is positioned right above the first receiving hole 21. As shown in FIG. 2, when the upper and lower slide plates 1 and 2 are slid most forward and backward, respectively, the rearranging hole 11 is positioned right above the second receiving hole 22.

Next, the working of the billet-rearranging device "A" will be described below.

(Initial State)

As shown in FIG. 1, in the initial state of the billet-rearranging device "A," the rearranging hole 11 of the upper slide plate 1 and the first receiving hole 21 of the lower slide plate 2 are in the center position 0. Accordingly, the first and second billets "b1" and "b2" fed from the chute "S" enter the first receiving hole 21 and the rearranging hole 11, respectively. Namely, the first billet "b1" falls onto the fixed plate 3 to rest in the first receiving hole 21 and the second billet "b2" falls onto the first billet "b1" to rest in the rearranging hole 11.

(Alignment)

Next, as shown in FIG. 2, the upper and lower slide plates 1 and 2 are slid most forward and most backward, respectively, so as to position the rearranging hole 11 right above the second receiving hole 22 and the first and second receiving holes 21 and 22 right above the first and second guide holes 31 and 32.

(Feeding)

Accordingly, the third billet "b3" falls onto the upper slide plate 1, the first billet "b1" falls from the first receiving hole 21 into the holder "B1" through the first guide hole 31 and the second billet "b2" falls from the rearranging hole 11 into the holder "B2" through the second receiving hole 22 and the second guide hole 32.

As described above, the first and second billets "b1" and "b2" are fed into the holders "B1" and "B2" in tandem. Next, the charger "Cg" moves the holder unit "B" forward to feed the first and second billets "b1" and "b2" to the pre-step 0 of the forging press "P."

INDUSTRIAL APPLICABILITY

This invention is applicable to a billet-rearranging device which receives billets in a row from a chute and feeds two billets in tandem at a time to the charger of an automatic forging press.

EXPLANATION OF REFERENCE NUMERALS AND SIGNS IN THE DRAWINGS

1 Upper slide plate
2 Lower slide plate
3 Fixed plate
11 Rearranging hole
21 First receiving hole
22 Second receiving hole
31 First guide hole
32 Second guide hole
S Chute
B Holder unit
Cg Charger

The invention claimed is:

1. A billet-rearranging device, disposed between a chute with an outlet to feed billets in a row to the device and a charger with a holder unit to hold two billets in tandem, said device having a billet-rearranging mechanism to rearrange two billets in tandem and feed them to the holder unit of the charger, wherein said billet-rearranging mechanism comprises:

an upper slide plate positioned below the outlet of the chute;

a lower slide plate positioned below the upper slide plate; and a fixed plate positioned below the lower slide plate, above the holder unit of the charger, wherein (A) the upper slide plate has the function of rearranging two billets in tandem, (B) the lower slide plate has the function of feeding two billets in tandem one by one to the fixed plate, and (C) the fixed plate has the function of guiding two billets in tandem simultaneously to the holder unit, and wherein (i) the holder unit of said charger is provided with a first and a second holder in tandem, the first holder being positioned in front of a position (hereinafter "center position") right under the outlet of said chute and the second holder being positioned in a rear of the center position, (ii) the fixed plate of the billet-rearranging mechanism of the billet-rearranging device has a first and a second guide hole which are positioned right above the first and second holders, respectively, of the holder unit of the charger, (iii) the lower slide plate of the billet-rearranging mechanism of the billet-rearranging device has a first and a second receiving hole, the first receiving hole coming to the center position when the lower slide plate is slid most forward and the first and second receiving holes positioned right above the first and second guide holes, respectively, of the fixed plate when the lower slide plate is slid most backward, and (iv) the upper slide plate of the billet-rearranging mechanism of the billet-rearranging device has a rearranging hole, the rearranging hole being positioned right above the first receiving hole of the lower slide plate when the upper and lower slide plates are slid most backward and forward, respectively, and the rearranging hole being positioned right above the second receiving hole of the lower slid plate when the upper and lower slide plates are slid most forward and backward, respectively.

* * * * *